US006559677B2

(12) United States Patent
Nitawaki

(10) Patent No.: US 6,559,677 B2
(45) Date of Patent: May 6, 2003

(54) DRIVING CIRCUIT FOR LCD

(75) Inventor: Shouji Nitawaki, Miyazaki (JP)

(73) Assignee: Oki Electric Industry Co.., Ltd., Tokyo (JP)

( * ) Notice: Subject to any disclaimer, the term of this patent is extended or adjusted under 35 U.S.C. 154(b) by 0 days.

(21) Appl. No.: 09/987,754

(22) Filed: Nov. 15, 2001

(65) Prior Publication Data

US 2002/0060590 A1 May 23, 2002

(30) Foreign Application Priority Data

Nov. 21, 2000 (JP) ..... 2000-354113

(51) Int. Cl.[7] ..... G09G 3/18

(52) U.S. Cl. ..... 326/83; 326/113; 326/81; 345/95; 345/51; 345/52; 345/210; 345/211

(58) Field of Search ..... 326/83, 86, 81, 326/113; 345/95, 210, 211, 51, 50, 52

(56) References Cited

U.S. PATENT DOCUMENTS 5,508,715 A * 4/1996 Kuroki ..... 345/51
5,568,070 A * 10/1996 Osaki et al. ..... 326/113
5,955,912 A * 9/1999 Ko ..... 327/410
6,107,981 A * 8/2000 Fujita ..... 345/95

FOREIGN PATENT DOCUMENTS

| | | |
|---|---|---|
| JP | 62-120117 | 6/1987 |
| JP | 5-46113 | 2/1993 |
| JP | 5-265407 | 10/1993 |
| JP | 9-214306 | 8/1997 |

* cited by examiner

*Primary Examiner*—Michael Tokar
*Assistant Examiner*—Vibol Tan
(74) *Attorney, Agent, or Firm*—Volentine Francos, PLLC

(57) ABSTRACT

A driving circuit includes a driving signal generating circuit which generates a plurality of driving signals; a plurality of switching circuits which are supplied with the driving signals so as to supply driving voltages in response to the driving signals, respectively; an output node which is connected to each of the switching circuits and is supplied with one of the driving voltages selectively; and a control circuit which controls the switching circuits so that any two of the switching circuits are not turned on simultaneously.

17 Claims, 8 Drawing Sheets

DRIVING CIRCUIT FOR LCD

CROSS REFERENCE TO RELATED APPLICATION

This application claims the priority of Application No. 2000-354113, filed Nov. 21, 2000 in Japan, the subject matter of which is incorporated herein by reference.

TECHNICAL FIELD OF THE INVENTION

The present invention relates to a driving circuit for driving an LCD (liquid crystal display) or the like.

BACKGROUND OF THE INVENTION

A conventional driving circuit is designed to drive segment electrodes in, for example, a matrix type LCD. According to a conventional driving circuit, a leakage current may flow between driving voltages via an output node. Although the leakage current caused in each driving circuit is small, as the number of driving circuits is increased in association with a trend toward a larger screen of the LCD, the total power consumption is increased. The increase in power consumption associated with the trend toward the larger screen is a serious problem especially in battery-powered portable displays.

OBJECTS OF THE INVENTION

Accordingly, it is an object of the present invention to provide a driving circuit in which the problems of the prior art are solved and in which no leakage current occurs in switching of a driving voltage.

Additional objects, advantages and novel features of the present invention will be set forth in part in the description that follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To solve the above problems, according to a first aspect of the present invention, there is provided a driving circuit having a plurality of switching units for, when receiving respective corresponding driving signals, outputting driving voltages corresponding to the driving signals to a common output node, the driving circuit including a driving control unit for, when a selection signal to select the driving voltage is activated, outputting the driving signal so as to be delayed by a predetermined time period and, when the selection signal is inactivated, immediately interrupting the driving signal.

Since the driving circuit is constructed as mentioned above, the following operation is performed.

For instance, when a selection signal to select a first driving voltage is inactivated at a certain instant and a selection signal to select a second driving voltage is activated, the driving control unit immediately interrupts a driving signal corresponding to the first driving voltage, thereby interrupting the first driving voltage generated from the switching unit. On the other hand, a driving signal corresponding to the second driving voltage is generated from the driving unit so as to be delayed by a predetermined time period. Consequently, after the first driving voltage is interrupted, the second driving voltage is generated from the switching unit after the predetermined time period.

According to a second aspect of the present invention, there is provided a driving circuit similar to that of the first aspect, the driving circuit including: selecting units for selecting a first clock signal when a selection signal to select a driving voltage is inactivated and, when the selection signal is activated, selecting a second clock signal delayed in phase relative to the first clock signal; and holding units for holding the selection signal on the basis of timing of the clock signal selected by the selecting unit and supplying the held contents as a driving signal to the switching unit.

In this aspect, the following operation is performed.

For example, when a selection signal to select a first driving voltage is inactivated at a certain instant and a selection signal to select a second driving voltage is activated, the selection signal corresponding to the first driving voltage is held by the holding unit at timing of the next first clock signal and, further, the selection signal corresponding to the second driving voltage is held by the holding unit at timing of the subsequent second clock signal. Consequently, the first driving voltage is interrupted at the timing of the first clock signal and, after that, the second driving voltage is outputted at the timing of the second clock signal.

According to a third aspect of the present invention, there is provided a driving circuit similar to that of the first aspect, the driving circuit including: selecting units similar to those of the second aspect of the present invention; holding units for holding a selection signal on the basis of timing of a clock signal selected by the selecting unit; and driving control units for, when the selection signal held by the holding circuit is activated, outputting the driving signal so as to be delayed by a predetermined time period and, when the selection signal is inactivated, immediately interrupting the driving signal.

In this aspect, the following operation is performed.

For instance, when a selection signal to select a first driving voltage is inactivated at a certain instant and a selection signal to select a second driving voltage is activated, the selection signal corresponding to the first driving voltage is held by the holding unit at timing of the next first clock signal and, further, the selection signal corresponding to the second driving voltage is held by the holding unit at timing of the subsequent second clock signal. As for the selection signals held by the holding units, the driving control units control delay time and each selection signal is supplied as a driving signal to the switching unit. Consequently, the first driving voltage is interrupted at the timing of the first clock signal and, after that, the second driving voltage is outputted so as to be further delayed relative to the timing of the second clock signal.

According to a fourth aspect of the present invention, there is provided a driving circuit similar to that of the first aspect, the driving circuit including: selecting units for selecting a first clock signal when an input signal is inactivated and, when the input signal is activated, selecting a second clock signal delayed in phase relative to the first clock signal; holding units for holding the input signal on the basis of timing of the clock signal selected by the selecting unit; and a decoding unit for decoding the held contents of the holding unit to form the driving signal for selecting the driving voltage and supply the driving signal to the switching unit.

In this aspect, the following operation is performed.

For example, when an input signal is inactivated at a certain instant, the selecting unit selects the first clock signal and the holding unit holds the input signal at timing of the next first clock signal. The held input signal is decoded by the decoding unit. A driving signal as a decoding result is supplied to the switching unit, thereby interrupting the corresponding driving voltage.

On the other hand, when the input signal is activated, the selecting unit selects the second clock signal delayed in phase relative to the first clock signal and the holding unit holds the input signal at timing of the next second clock signal. The input signal held by the holding unit is decoded by the decoding unit and a driving signal as a decoding result is supplied to the switching unit, thereby outputting the corresponding driving voltage.

According to a fifth aspect of the present invention, there is provided a driving circuit similar to that of the first aspect, the driving circuit including: selecting units and holding units similar to those of the fourth aspect; a decoding unit for decoding the held contents of the holding units to form a selection signal to select the driving voltage; and a driving control unit for, when the selection signal is activated, outputting the driving signal so as to be delayed by a predetermined time period, and when the selection signal is inactivated, immediately interrupting the driving signal.

In this aspect, the following operation is performed.

For example, when an input signal is inactivated at a certain instant, the selecting unit selects the first clock signal and the holding unit holds the input signal at timing of the next first clock signal. On the other hand, when the input signal is activated, the selecting unit selects a second clock signal delayed in phase relative to the first clock signal and the holding unit holds the input signal at timing of the next second clock signal.

The input signal held by the holding unit is decoded by the decoding unit, thereby forming a selection signal to select a driving voltage. The selection signal is supplied to the driving control unit. In the inactivation, the driving signal to immediately interrupt the driving voltage is supplied to the switching unit and, in the activation, the driving signal to output the driving voltage so as to be delayed by a predetermined time period is supplied to the switching unit.

Preferably, in the first, third, or fifth aspect of the present invention, the driving control unit is constructed by logic gates each having an output unit obtained by serially connecting complementary MOSs having different mutual conductance from each other.

According to a sixth aspect of the present invention, there is provided a driving circuit for outputting any one of a plurality of driving voltages to a common output node, the driving circuit including: a driving signal output circuit for outputting a plurality of driving signals corresponding to the plurality of driving voltages on the basis of a plurality of selection signals; and a plurality of switching units, which are controlled by the plurality of driving signals, respectively, for outputting the driving signal corresponding to any one of the plurality of driving voltages to the output node, wherein the driving signal output circuit is constructed so as to generate the plurality of driving signals to allow a transition from an ON state to an OFF state of the switching unit to be faster than that from the OFF state to the ON state thereof.

Preferably, in the sixth aspect, the driving signal output circuit has a first conductivity type first MOS coupled between an output terminal thereof and a power supply potential and a second conductivity type second MOS coupled between the output terminal and a ground potential, when the switching unit is a first conductivity type MOS, the ratio of gate length to gate width of the second MOS is larger than that of the first MOS, and when the switching unit is a second conductivity type MOS, the ratio of gate length to gate width of the first MOS is larger than that of the second MOS.

Preferably, in the sixth aspect, the driving signal output circuit has a first conductivity type first MOS coupled between an output terminal thereof and a power supply potential and a second conductivity type second MOS coupled between the output terminal and a ground potential, when the switching unit is a first conductivity type MOS, the ratio of gate width to gate length of the second MOS is smaller than that of the first MOS, and when the switching unit is a second conductivity type MOS, the ratio of gate width to gate length of the first MOS is smaller than that of the second MOS.

Preferably, in the sixth aspect, the driving signal output circuit has a first conductivity type first MOS coupled between an output terminal thereof and a power supply potential and a second conductivity type second MOS coupled between the output terminal and a ground potential, when the switching unit is a first conductivity type MOS, the ON resistance of the second MOS is larger than that of the first MOS, and when the switching unit is a second conductivity type MOS, the ON resistance of the first MOS is larger than that of the second MOS.

Preferably, in this aspect, the driving signal is generated so as to control the switching unit on the basis of one of a first clock signal and a second clock signal delayed in phase relative to the first clock signal, when the driving signal allows the switching unit to change from the OFF state to the ON state, the driving signal is outputted on the basis of the second clock signal, and when the driving signal allows the switching unit to change from the ON state to the OFF state, the driving signal is outputted on the basis of the first clock signal.

Preferably, the driving circuit according to this aspect includes: clock signal selecting units for selecting either one of the first and second clock signals; selection signal holding units for holding the selection signal on the basis of the first or second clock signal selected by the clock signal selecting unit; and a decoding unit for decoding the held contents of the selection signal holding unit to form the driving signal corresponding to the driving voltage.

According to this aspect, the following operation is performed.

The driving signal to allow the transition from the ON state to the OFF state to be faster than that from the OFF state to the ON state is outputted from the driving signal output circuit to the switching unit. Consequently, a fear of simultaneously turning on the plurality of switching units is eliminated.

According to a seventh aspect of the present invention, there is provided a driving circuit for outputting one of first and second driving voltages to a common output node, the driving circuit including: a first driving signal output circuit for outputting a first driving signal corresponding to the first driving voltage on the basis of a first selection signal; a second driving signal output circuit for outputting a second driving signal corresponding to the second driving voltage on the basis of a second selection signal; a first switching unit, which is controlled by the first driving signal, for outputting the first driving voltage to the output node; and a second switching unit, which is controlled by the second driving signal, for outputting the second driving voltage to the output node, wherein the first and second driving signal output circuits output the first and second driving signals for allowing a transition from an ON state to an OFF state of the second switching unit to be faster than that from the OFF state to the ON state of the first switching unit, respectively.

Preferably, in the seventh aspect, one of the first and second driving signal output circuits has a first conductivity type first MOS coupled between an output terminal thereof and a power supply potential and a second conductivity type second MOS coupled between the output terminal and a ground potential, when one of the first and second switching units is a first conductivity type MOS, the ratio of gate length to gate width of the second MOS is larger than that of the first MOS, and when one of the first and second switching units is a second conductivity type MOS, the ratio of gate length to gate width of the first MOS is larger than that of the second MOS.

Preferably, in the seventh aspect, one of the first and second driving signal output circuits has a first conductivity type first MOS coupled between an output terminal thereof and a power supply potential and a second conductivity type second: MOS coupled between the output terminal and a ground potential, when one of the first and second switching units is a first conductivity type MOS, the ratio of gate width to gate length of the second MOS is smaller than that of the first MOS, and when one of the first and second switching units is a second conductivity type MOS, the ratio of gate width to gate length of the first MOS is smaller than that of the second MOS.

Preferably, in the seventh aspect, one of the first and second driving signal output circuits has a first conductivity type first MOS coupled between an output terminal thereof and a power supply potential and a second conductivity type second MOS coupled between the output terminal and a ground potential, when one of the first and second switching units is a first conductivity type MOS, the ON resistance of the second MOS is larger than that of the first MOS, and when one of the first and second switching units is a second conductivity type MOS, the ON resistance of the first MOS is larger than that of the second MOS.

Preferably, in this aspect, the first and second driving signals are outputted so as to control the first and second switching units on the basis of one of a first clock signal and a second clock signal delayed in phase relative to the first clock signal, when the first switching unit changes from an OFF state to an ON state by the first driving signal, the first driving signal is outputted on the basis of the second clock signal, and when the second switching unit changes from the ON state to the OFF state by the second driving signal, the second driving signal is outputted on the basis of the first clock signal.

Preferably, the driving circuit according to this aspect includes: clock signal selecting units for selecting either one of the first and second signals; first and second selection signal holding units for holding the first and second selection signals on the basis of one of the first and second clock signals selected by the clock signal selecting unit, respectively; and first and second decoding units for decoding the held contents of the first and second selection signal holding circuit to form the first and second driving signals corresponding to the first and second driving voltages, respectively.

According to this aspect, the following operation is performed.

The first driving signal to switch the switching unit from the OFF state to the ON state is generated from the first driving signal output circuit to the first switching unit. The second driving signal to switch the switching unit from the ON state to the OFF state is generated from the second driving signal output circuit to the second switching unit. On the basis of the first and second driving signals, the second switching unit is first turned off and, after that, the first switching unit is turned on. Consequently, there is no fear that the first and second switching units are simultaneously turned on.

DETAILED DISCLOSURE OF THE INVENTION

In the following detailed description of the preferred embodiments, reference is made to the accompanying drawings which forma part hereof, and in which is shown by way of illustration specific preferred embodiments in which the inventions may be practiced. These embodiments are described in sufficient detail to enable those skilled in the art to practice the invention, and it is to be understood that other embodiments may be utilized and that logical, mechanical and electrical changes may be made without departing from the spirit and scope of the present inventions. The following detailed description is, therefore, not to be taken in a limiting sense, and scope of the present inventions is defined only by the appended claims.

Figure 1:
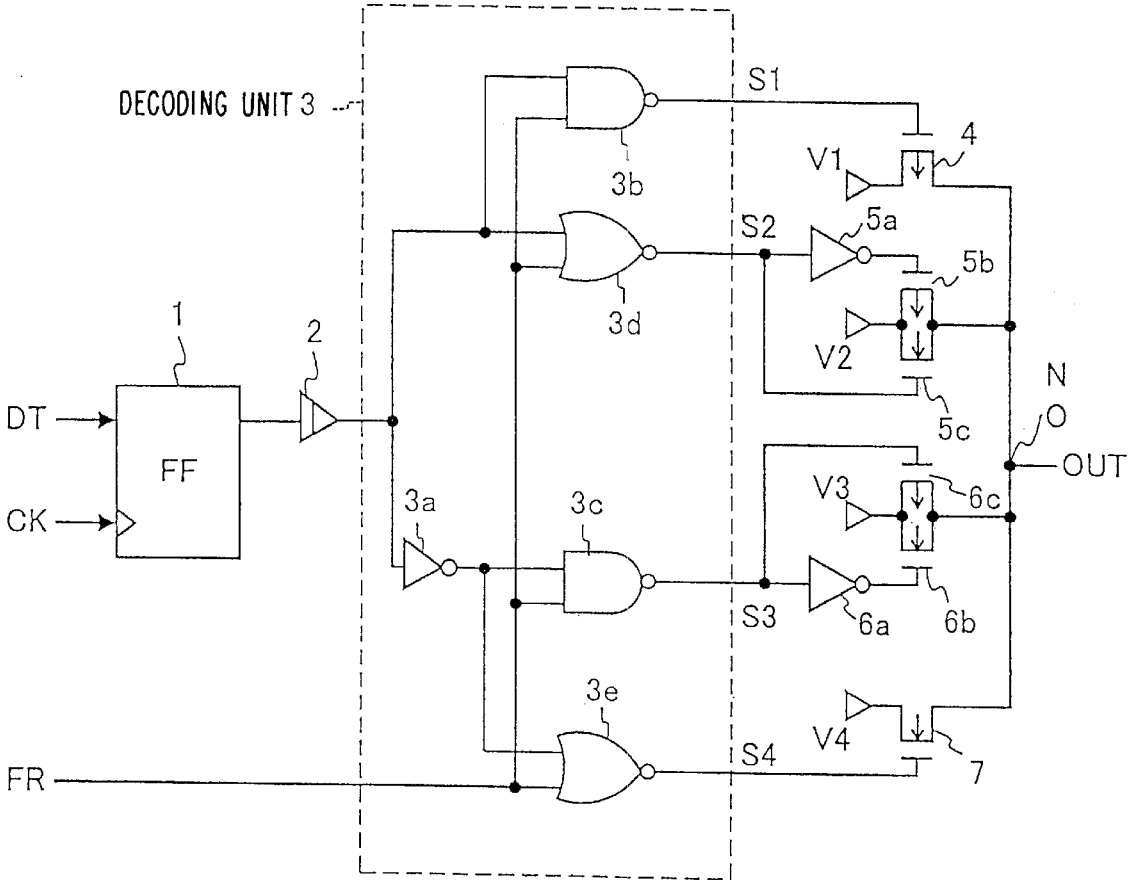
FIG. 1 (PRIOR ART)
FIG. 1 is a block diagram showing a conventional driving circuit for LCD.

For better understanding of the present invention, a conventional technology is first described. FIG. 1 is a circuit diagram showing a conventional driving circuit. The driving circuit drives segment electrodes in, for example, a matrix type LCD. The circuit has a flip-flop (hereinbelow, referred to as an "FF") 1 which receives display data DT and a clock signal CK. An output of the FF 1 is coupled to a decoding unit 3 through a level shifter 2. The decoding unit 3 selects any one of four driving signals S1, S2, S3, and S4 in accordance with the combination of the display data DT supplied through the level shifter 2 and a frame control signal FR. For example, the decoding unit 3 comprises an inverter 3*a*, NAND gates (hereinbelow, referred to as "NANDs") 3*b* and 3*c*, and NOR gates (hereinbelow, referred to as "NORs") 3*d* and 3*e*.

The driving signal S1 is supplied to a gate of a P-channel MOS transistor (hereinbelow, a MOS transistor is simply referred to as an "MOS" and a P-channel MOS transistor is referred to as a "PMOS") 4 for controlling the turning on/off of a driving voltage V1 for driving the LCD. The driving signal S2 is supplied through an inverter 5*a* to a gate of a PMOS 5*b* for controlling the turning on/off of a driving voltage V2 and is also supplied to a gate of an N-channel MOS (hereinbelow, referred to as an "NMOS") 5*c* for controlling the turning on/off of the driving voltage V2. The driving signal S3 is supplied through an inverter 6*a* to a gate of an NMOS 6*b* for controlling the turning on/off of a driving voltage V3 and is also supplied to a gate of a PMOS 6*c* for controlling the turning on/off of the driving voltage V3. The driving signal S4 is supplied to a gate of an NMOS 7 for controlling the turning on/off of a driving voltage V4.

Outputs of the PMOSs 4, 5*b*, and 6*c* and NMOSs 5*c*, 6*b*, and 7 are coupled in common to an output node NO and connected to one of segment electrodes of the LCD (not shown).

In the driving circuit, the display data DT is held by the FF 1 at the rising edge of the clock signal CK, shifted to an LCD-side signal level by the level shifter 2, and then supplied to the decoding unit 3. The decoding unit 3 receives the frame control signal FR. In accordance with the combination of the data and the signal, only one signal is selected from among the four driving signals S1 to S4.

For example, when both the display data DT and the frame control signal FR denote a level "L" (low), the driving signals S1 to S3 become a level "H" (high) and the driving signal S4 goes to the level "L". Thereby, the PMOS 5*b* and the NMOS 5*c* are turned on to output the driving voltage V2. Subsequently, when the display data DT is at the level "L" and the frame control signal FR changes to the level "H", the driving signal S1 goes to the level "H" and the driving signals S2 to S4 go to the level "L". Consequently, the NMOS 6*b* and the PMOS 6*c* are turned on to output the driving voltage V3.

In this manner, the driving voltages V2 and V3 are alternately selected according to the frame control signal FR and are supplied to the segment electrode of the LCD. Accordingly, by setting the polarities of the driving voltages V2 and V3 so as to be opposite to each other, the LCD is AC-driven at a frame period, so that it is possible to maintain a long operating life.

However, the conventional driving circuit has the following problems.

As for the circuit elements serving as NANDs 3*b* and 3*c*, and NORs 3*d* and 3*e* of the decoding unit 3, the operation speed is limited. When the output signal thereof changes from the level "L" to the level "H" or from the level "H" to the level "L", there is a time zone during which the output signal goes to a middle level therebetween. Consequently, for example, while the driving voltage V2 is switched to the driving voltage V3, the PMOSs 5*b* and 6*c* and the NMOSs 5*c* and 6*b* momentarily enter an intermediate state between the ON state and the OFF state, so that a leakage current flows between the driving voltages V2 and V3 via the output node NO.

Although the leakage current caused in each driving circuit is small, as the number of driving circuits is increased in association with a trend toward a larger screen of the LCD, the total power consumption is increased. The increase in power consumption associated with the trend toward the larger screen is a serious problem especially in battery-powered portable displays.

First Embodiment

Figure 2:
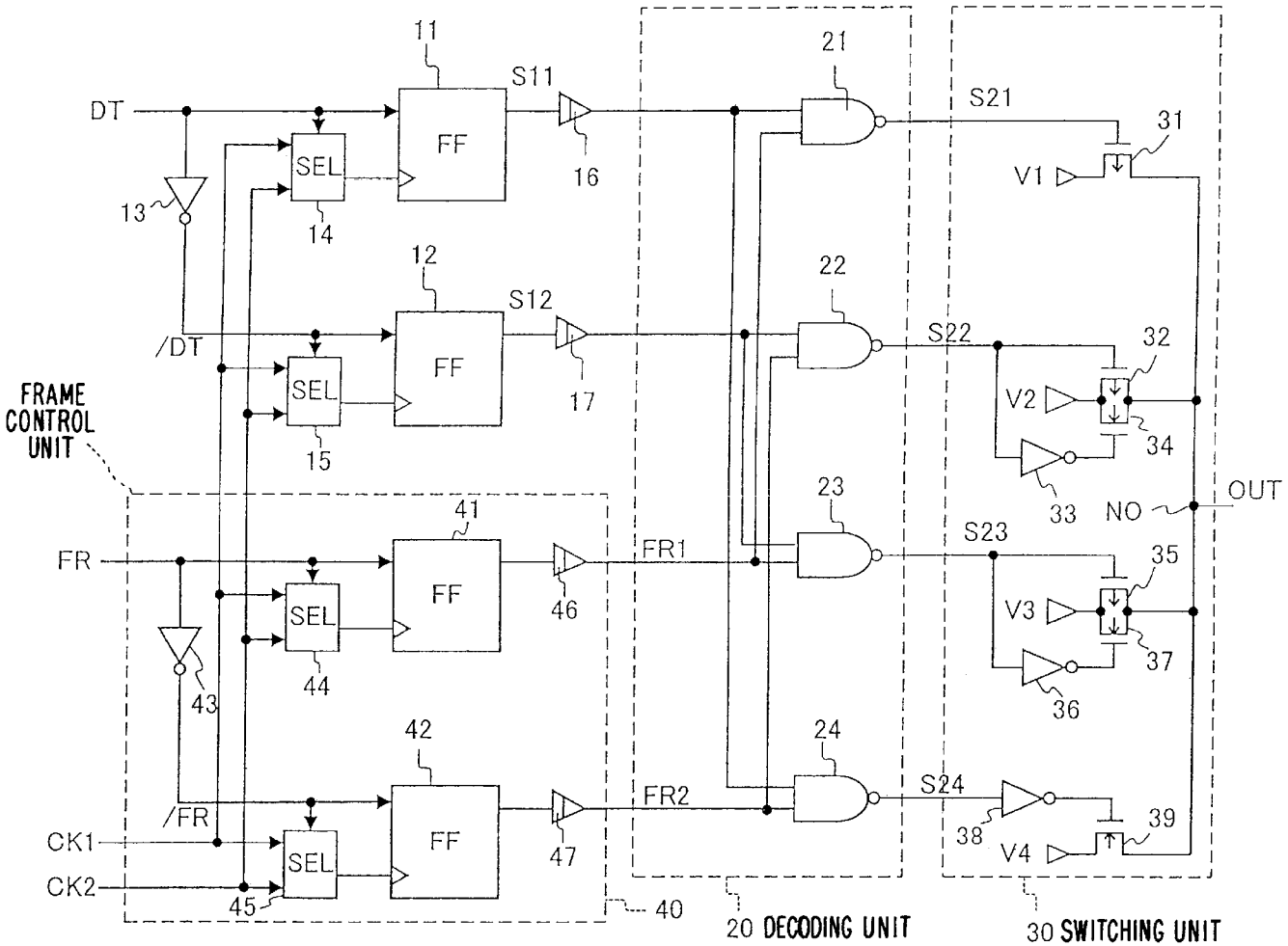
FIG. 2 is a block diagram showing a driving circuit for LCD according to a first preferred embodiment of the present invention.

FIG. 2 is a circuit diagram of a driving circuit showing a first embodiment of the present invention.

The driving circuit drives segment electrodes in, for example, a matrix type LCD and has holding circuits (e.g., FFs) 11 and 12 for holding an input signal (e.g., display data) DT corresponding to one segment electrode. The display data DT is supplied to an input terminal of the FF 11. Display data /DT inverted by an inverter 13 is supplied to an input terminal of the FF 12. A clock signal selected by selecting circuit (for example, a selector (SEL)) 14 is supplied to a clock terminal of the FF 11 and a clock signal selected by a selector 15 is supplied to a clock terminal of the FF 12. A clock signal CK1 and a clock signal CK2 delayed in phase relative to the signal CK1 are supplied to two input terminals of each of the selectors 14 and 15. The display data DT is supplied to a control terminal of the selector 14 and the display data /DT is supplied to a control terminal of the selector 15. Each of the selectors 14 and 15 selects one of the clock signals CK1 and CK2 in accordance with the level "L" or "H" of the signal supplied to the control terminal and then outputs the selected signal.

Outputs of the FFs 11 and 12 are coupled to decoding circuit and driving control circuit (e.g., a decoding unit) 20 through level shifters 16 and 17, respectively. The level shifters 16 and 17 convert output signals S11 and S12 of the FFs 11 and 12 into LCD-side signal levels, respectively. The decoding unit 20 selects any one of four driving signals S21, S22, S23, and S24 in accordance with the combination of the display data DT and /DT supplied through the level shifters 16 and 17 and frame control signals FR1 and FR2, and then outputs the selected one. The decoding unit 20 comprises four NANDs 21, 22, 23, and 24. The driving signals S21, S22, S23, and S24 decoded by the NANDs 21 to 24 are inputted to switching circuit (for example, a switching unit) 30 for generating any one of the driving voltages V1, V2, V3, and V4 as an output signal OUT to the output node NO.

The driving signal S21 is inputted to a gate of a PMOS 31 for controlling the turning on/off of the driving voltage V1 for driving the LCD. The driving signal S22 is supplied to a gate of a PMOS 32 for controlling the turning on/off of the driving voltage V2 and is also inputted to a gate of an NMOS 34, which is connected in parallel to the PMOS 32, via an inverter 33. The driving signal S23 is supplied to a gate of a PMOS 35 for controlling the turning on/off of the driving voltage V3 and is also supplied to a gate of an NMOS 37 connected in parallel to the PMOS 35 through an inverter 36. The driving signal S24 is inputted to a gate of an NMOS 39 for controlling the turning on/off of the driving voltage V4 through an inverter 38.

Outputs of the PMOSs 31, 32, and 35, and NMOSs 34, 37, and 39 are connected in common to the output node NO and coupled to one of the segment electrodes of the LCD (not shown).

The driving circuit further includes a frame control unit 40 for forming the frame control signals FR1 and FR2 common to the segment electrodes on the basis of the frame control signal FR.

The frame control unit 40 has FFs 41 and 42 for holding the frame control signal FR common to the LCD. The frame control signal FR is supplied to an input terminal of the FF 41. A frame control signal/FR inverted by an inverter 43 is supplied to an input terminal of the FF 42. The clock signal selected by a selector 44 is supplied to a clock terminal of the FF 41 and the clock signal selected by a selector 45 is inputted to a clock terminal of the FF 42. Similar to the selector 14, each of the selectors 44 and 45 selects one of the clock signals CK1 and CK2 in accordance with the level "H" or "L" of the signal supplied to the control terminal and then outputs it.

An output of the FF 41 is coupled to a level shifter 46 and that of the FF 42 is coupled to a level shifter 47. The level shifter 46 outputs the frame control signal FR1 and the level shifter 47 outputs the frame control signal FR2. They are supplied in common to the decoding unit 20 dealing with the display data DT.

Figure 3A:
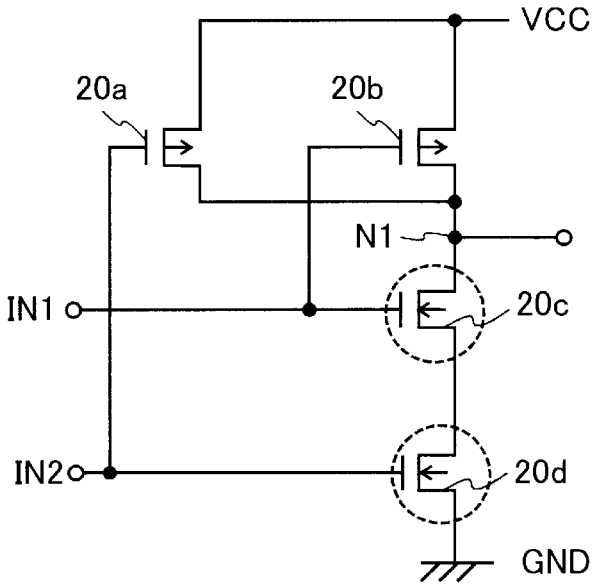
FIG. 3A is a circuit diagram showing a NAND circuit used in the first preferred embodiment.
Figure 3B:
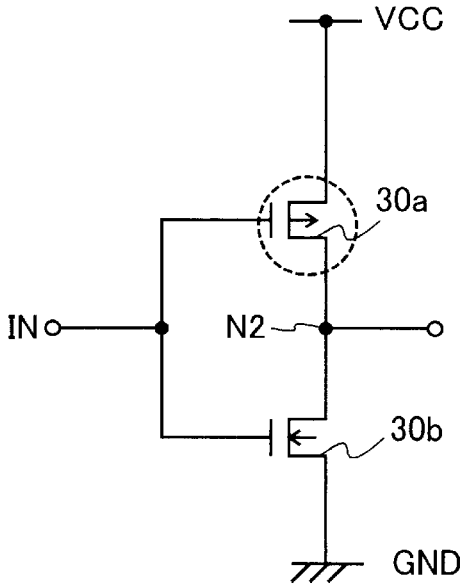
FIG. 3B is a circuit diagram showing an inverter circuit used in the first preferred embodiment.

FIGS. 3A and 3B are constructional diagrams of the NANDs and inverters in FIG. 1, respectively. FIG. 3A shows the construction of the NAND 21 and similar components in the decoding unit 20 and FIG. 3B shows the construction of the inverter 33 and similar components in the switching unit 30.

As shown in FIG. 3A, in the NAND 21, two PMOSs 20*a* and 20*b*, which are gate-controlled by input signals IN1 and IN2, respectively, are connected in parallel between a power supply voltage VCC and an output node N1. Further, between the output node N1 and a ground voltage GND, two NMOSs 20*c* and 20*d*, which are gate-controlled by the input signals IN1 and IN2, respectively, are connected in series. The two NMOSs 20*c* and 20*d* are set so that the mutual conductance gm is smaller, namely, the ON resistance is larger than that of each of the PMOSs 20*a* and 20*b*.

Specifically, when it is assumed that the ratio of gate length to gate width of each of the PMOSs 20*a* and 20*b* is set to 1:5, the ratio of gate length to gate width of each of the NMOSs 20*c* and 20*d* is set to, e.g., 10:5. Alternatively, the ratio of gate width to gate length of each of the NMOSs 20*c* and 20*d* is set smaller than that of each of the PMOSs 20*a* and 20*b*. Consequently, a response speed when the NMOSs 20*c* and 20*d* change from the OFF state to the ON state is slower than that when they change from the ON state to the OFF state. Accordingly, the NANDs 21 etc. have such characteristics that the response speed at the rising edge from the level "L" to the level "H" of the output signal is high and that at the falling edge from the level "H" to the level "L" thereof is low.

As shown in FIG. 3B, in the inverters 33 etc., a PMOS 30*a* gate-controlled by an input signal IN is connected between the power supply voltage VCC and an output node N2. Between the output node N2 and the ground voltage GND, an NMOS 30*b* gate-controlled by the input signal IN is connected. The PMOS 30*a* is set so that the mutual conductance gm is smaller than that of the NMOS 30*b*. Specifically, when it is assumed that the ratio of gate length to gate width of the NMOS 30*b* is set to 1:5, that of the PMOS 30*a* is set to, for instance, 10:5. Alternatively, the ratio of gate width to gate length of the PMOS 30*a* is set smaller than that of the NMOS 30*b*. Consequently, a response speed when the PMOS 30*a* changes from the OFF state to the ON state is lower than that when it changes from the ON state to the OFF state. Therefore, the inverters 33 etc. have such characteristics that the response speed at the rising edge from the level "L" to the level "H", of the output signal is low and that at the falling edge from the level "H" to the level "L" thereof is high.

Figure 4:
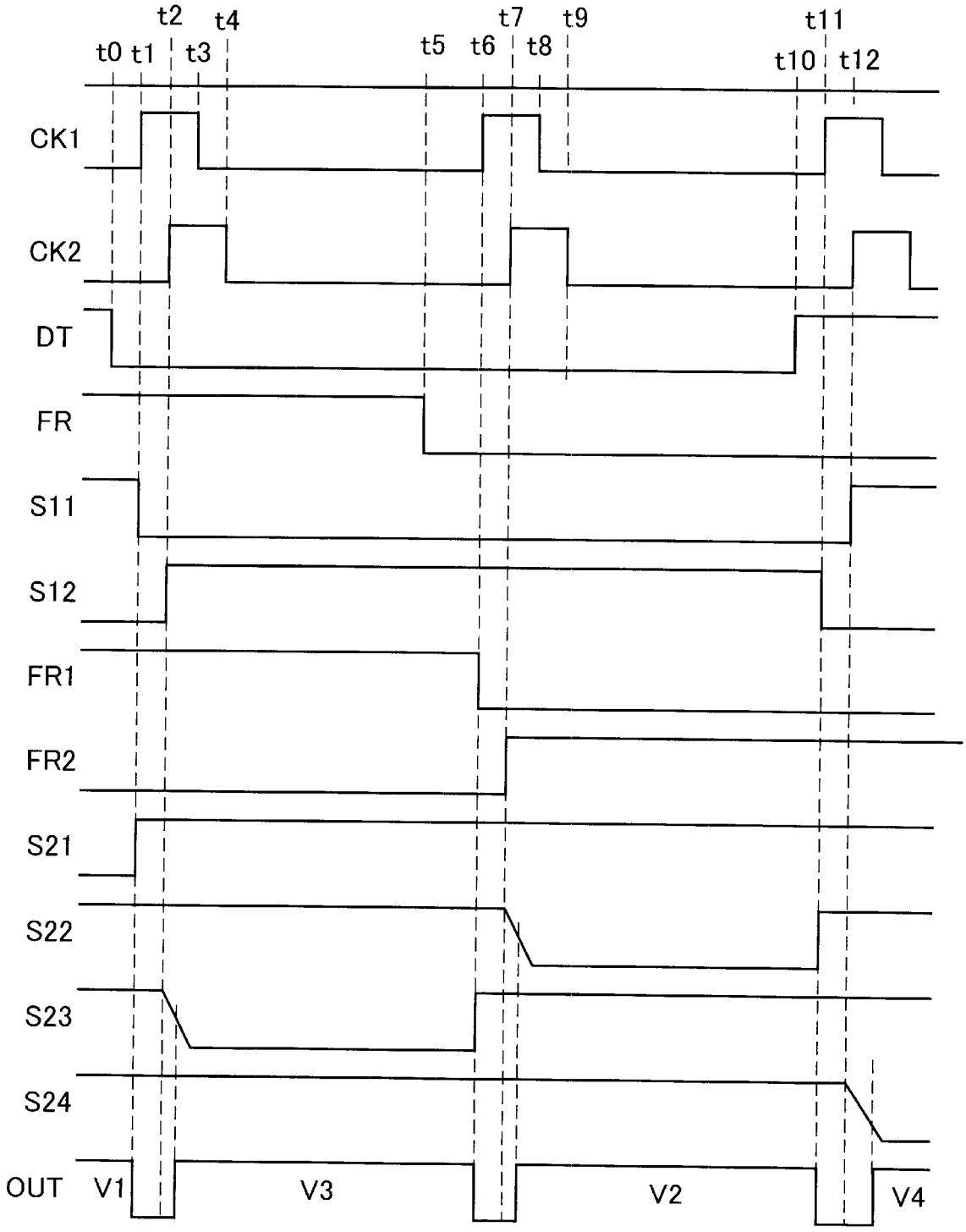
FIG. 4 is a timing chart showing waveforms of signals used in the first preferred embodiment.

FIG. 4 is a signal waveform diagram showing the operation in FIG. 2. The operation in FIG. 2 will now be described hereinbelow with reference to FIG. 4.

Referring to FIG. 4, at time t0, when the display data DT goes to the level "L", the selector 14 selects the clock signal CK1 and the selector 15 selects the clock signal CK2. At that time, the frame control signal FR becomes the level "H", the selector 44 selects the clock signal CK2, and the selector 45 selects the clock signal CK1.

At time t1, when the clock signal CK1 rises, the FF 11 holds the display data DT at the level "L". The signal S11 generated from the FF 11 changes from the level "H" to the level "L". Since the clock signal CK2 of the FF 12 does not rise, the signal S12 held and generated by the FF 12 is at the level "L". On the other hand, the held contents of the FFs 41 and 42 are not changed, the frame control signal FR1 is at the level "H", and the frame control signal FR2 is at the level "L".

Consequently, the driving signal S21 generated from the NAND 21 of the decoding unit 20 changes from the level "L" to the level "H" and the PMOS 31 of the switching unit 30 is turned off to cut off the driving voltage V1 generated as an output signal OUT to the output node NO.

Subsequently, at time t2, when the clock signal CK2 rises, the FF 12 holds the display data /DT at the level "H" and the signal S12 generated from the FF 12 changes from the level "H" to the level "L". Consequently, the driving signal S23 outputted from the NAND 23 of the decoding unit 20 gently changes from the level "H" to the level "L" and the PMOS 35 of the switching unit 30 is turned on slightly after time t2. After that, the output signal of the inverter 36 becomes the level "H" to turn the NMOS 37 on. Consequently, the driving voltage V3 is generated as an output signal OUT.

After that, at time t3 and t4, although the clock signals CK1 and CK2 sequentially fall, the held contents of the FFs 11 to 42 are not changed and the output signal OUT is not changed.

At time t5, when the frame control signal FR changes from the level "H" to the level "L", the selector 44 selects the clock signal CK1 and the selector 45 selects the clock signal CK2.

At time t6, when the clock signal CK1 rises, the FF 41 holds the frame control signal FR at the level "L" and the frame control signal FR1 generated from the FF 41 changes from the level "H" to the level "L". Consequently, the driving signal S23 outputted from the NAND 23 of the decoding unit 20 changes from the level "L" to the level "H" and the PMOS 35 and the NMOS 37 of the switching unit 30 are turned off to cut off the driving voltage V3 generated as an output signal OUT. Subsequently, at time t7, when the clock signal CK rises, the FF 42 holds the frame control signal /FR at the level "H" and the frame control signal FR2 generated from the FF 42 changes from the level "L" to the level "H". Consequently, the driving signal S22 generated from the NAND 22 of the decoding unit 20 gently changes from the level "H" to the level "L" and the PMOS 32 of the switching unit 30 is turned on slightly after time t7. Later still, the output signal of the inverter 33 becomes the level "H" t6 turns on the NMOS 34. The driving voltage V2 is generated from the output.node NO.

Similarly, at time t8 and t9, although the clock signals CK1 and CK2 sequentially fall, the held contents of the FFs 11 to 42 are not changed and the output signal OUT is not also changed.

At time t10, the display data DT changes to the level "H" and, after that, at time t11, when the clock signal CK1 rises, the driving signal S22 outputted from the NAND 22 of the decoding unit 20 changes from the level "L" to the level "H", so that the driving voltage V2 generated as an output signal OUT is cut off. Further, at time t12, when the clock signal CK2 rises, the driving signal S24 outputted from the NAND 24 of the decoding unit 20 gradually changes from the level "H" to the level "L", the NMOS 39 of the switching unit 30 is turned on slightly after time t12, and the driving voltage V4 is outputted as an output signal OUT.

As mentioned above, the driving circuit according to the first embodiment uses the two clock signals CK1 and CK2 having different phases to provide a period during which none of the driving signals S21 to S24 are generated. Consequently, a case in which two switches of the switching unit 30 are simultaneously turned on is eliminated, so that there is an advantage in that a leakage current among the driving voltages V1 to V4 can be prevented.

Further, the NANDs 21 to 24 of the decoding unit 20 are constructed so as to extend the delay time at the falling edge of the output signal and so as to extend the delay time at the rising edge of the output signal of each of the inverters 33, 36, and 38. Consequently, there is an advantage in that after the NMOS or PMOS of the switching unit 30 is turned off, the turn-on time is delayed, so that the leakage current can be effectively prevented.

Second Embodiment

Figure 5:
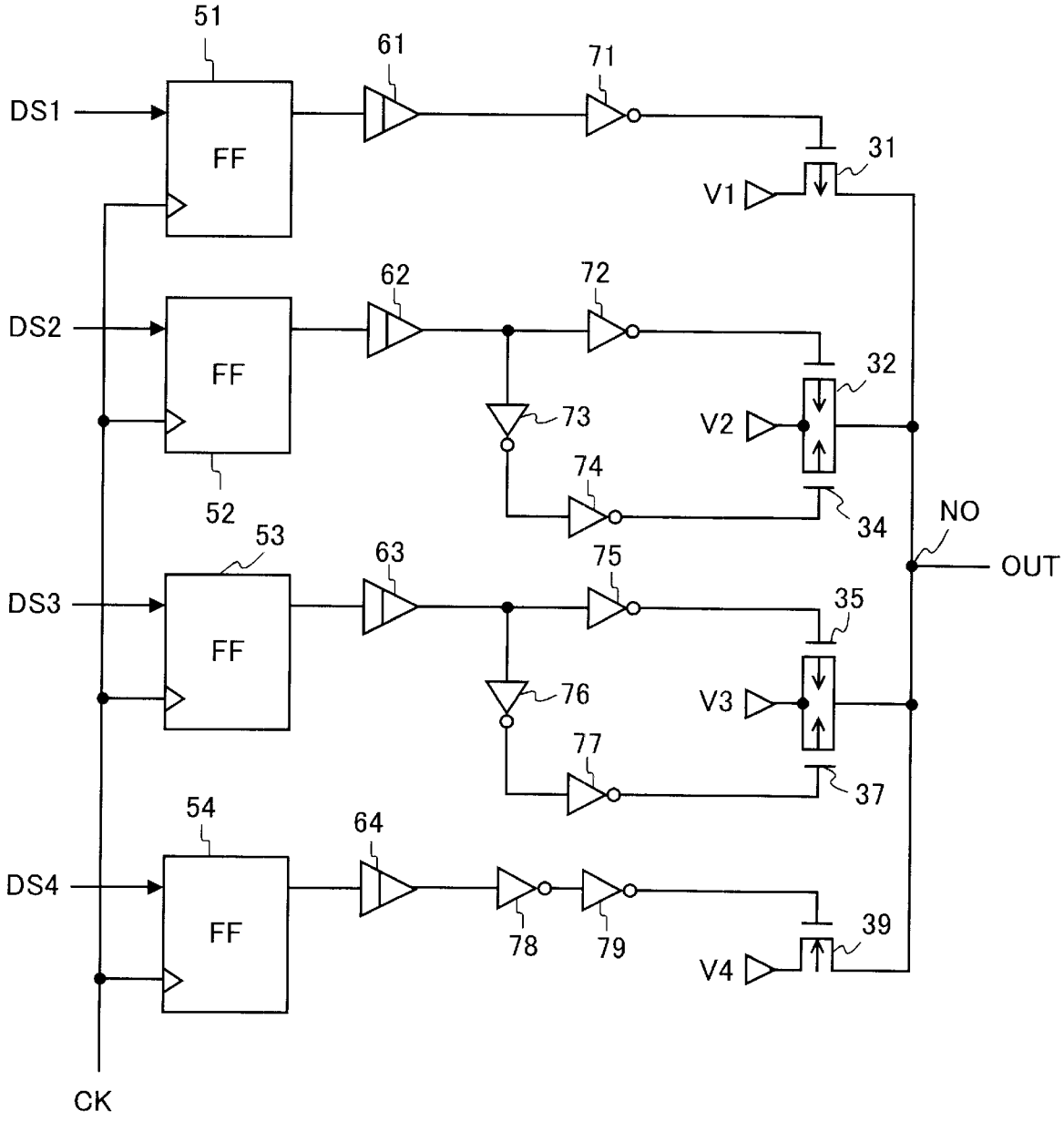
FIG. 5 is a block diagram showing a driving circuit for LCD according to a second preferred embodiment of the present invention.
Figure 6A:
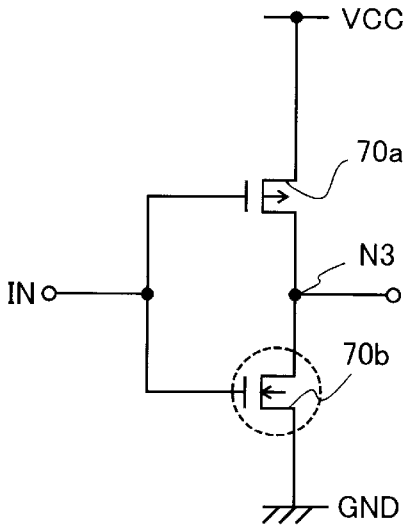
FIG. 6A is a circuit diagram showing an inverter circuit for controlling a PMOS used in the second preferred embodiment.
Figure 6B:
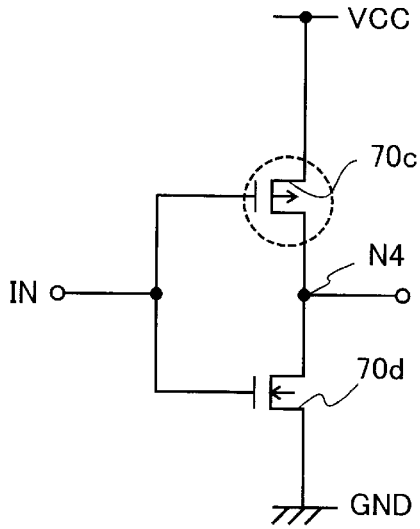
FIG. 6B is a circuit diagram showing an inverter circuit for controlling an NPMOS used in the second preferred embodiment.

FIGS. 5, 6A and 6B are circuit diagrams regarding a driving circuit showing a second embodiment of the present invention. FIG. 5 shows a circuit construction, FIG. 6A shows the construction of an inverter for PMOS control, and FIG. 6B shows the construction of an inverter for NMOS control. Referring to FIG. 5, components common to those in FIG. 2 are designated by the common reference numerals and symbols.

As shown in FIG. 5, the driving circuit includes holding circuits (for example, FFs) 51, 52, 53, and 54 for holding selection signals DS1, DS2, DS3, and DS4 for selecting a driving voltage for display in accordance with the rising of the common clock signal CK. The selection signals DS1 to DS4 are signals corresponding to the driving voltages V1 to V4, respectively. Each signal is obtained by decoding, for example, the display data DT and the frame control signal FR in FIG. 2. Any one of the selection signals becomes the level "H" and the other signals go to the level "L".

Outputs of the FFs 51 to 54 are coupled to level shifters 61 to 64, respectively. An output of the level shifter 61 is connected to a gate of the switching circuit (for example, PMOS) 31 for turning the driving voltage V1 on/off through driving control circuit (e.g., an inverter) 71 for controlling the PMOS. An output of the level shifter 62 is coupled to a gate of the PMOS 32 via an inverter 72 for controlling the PMOS and is also connected to a gate of the NMOS 34 via an inverter 73 for logic inversion and an inverter 74 for NMOS control. The PMOS 32 and NMOS 34 turn the driving voltage V2 on or off.

An output of the level shifter 63 is coupled to a gate of the PMOS 35 via an inverter 75 for PMOS control and is also connected to a gate of the NMOS 37 via an inverter 76 for logic inversion and an inverter 77 for NMOS control. The PMOS 35 and NMOS 37 turn the driving voltage V3 on/off. Further, an output of the level shifter 64 is connected to a gate of the NMOS 39 for turning the driving voltage V4 on/off through an inverter 78 for logic inversion and an inverter 79 for NMOS control.

The outputs of the PMOSs 31, 32, and 35 and the NMOSs 34, 37, and 39 are connected in common to the output node NO. The output signal OUT generated therefrom is supplied to one of the segment electrodes of the LCD (not shown).

In each of the inverters 71, 72, and 75 for PMOS control, as shown in FIG. 6A, a PMOS 70*a* gate-controlled by the input signal IN is connected between the power supply voltage VCC and an output node N3 and an NMOS 70*b* gate-controlled by the input signal IN is connected between the output, node N3 and the ground voltage GND. The NMOS 70*b* is set so that the mutual conductance gm is smaller than that of the PMOS 70*a*. Specifically, when it is assumed that the ratio of gate length to gate width of the PMOS 70*a* is set to 1:5, the ratio of gate length to gate width of the NMOS 70*b* is set to, for example, 10:5. Alternatively, the ratio of gate width to gate length in the NMOS 70*b* is set so as to be slammer than that of the PMOS 70*a*. Consequently, the response speed when the NMOS 70*b* changes from the OFF state to the ON state is slower than that when it changes from the ON state to the OFF state. Therefore, the inverter 71 and the like have such characteristics that the response speed at the falling edge from the level "H" to the level "L" of the output signal is low and that at the rising edge from the level "L" to the level "H" thereof is high.

On the other hand, in each of the inverters 74, 77, and 79 for NMOS control, as shown in FIG. 6B, a PMOS 70*c* gate-controlled by the input signal IN is connected between the power supply voltage VCC and an output node N4, and an NMOS 70d gate-controlled by the input signal IN is connected between the output node N4 and the ground voltage GND. The PMOS 70*c* is set so that the mutual conductance gm is smaller than that of the PMOS 70*d*. Specifically, when it is assumed that the ratio of gate length to gate width of the NMOS 70*d* is set to 1:5, the ratio of gate length to gate width of the PMOS 70*c* is set to, for example, 10:5. Alternatively, the ratio of gate width to gate length of the PMOS 70*c* is set smaller than that of the NMOS 70*d*. Therefore, the inverter 74 and the like have such characteristics that the rising operation is slow and the falling operation is fast.

Subsequently, the operation will now be described.

For example, it is assumed that the clock signal CK rises, so that an output signal of the FF 51 changes from the level "H" to the level "L" and an output signal of the FF 52 changes from the level "L" to the level "H".

The output signal of the FF 51 is supplied to the inverter 71 via the level shifter 61, thereby being inverted. Consequently, an output signal of the inverter 71 immediately rises from the level "L" to the level "H". Therefore, the PMOS 3 changes from the ON state to the OFF state in association with the rising edge of the clock signal CK, so that the driving voltage VI is instantly cut off.

On the other hand, an output signal of the FF 52 is supplied to the inverters 72 and 73 through the level shifter 62, thereby being inverted. Consequently, an output signal of the inverter 72 falls from the level "H" to the level "L" so as to be slightly delayed. The signal inverted by the inverter 73 is further supplied to the inverter 74, thereby being inverted. Consequently, an output signal of the inverter 74 rises from the level "L" to the level "H" so as to be slightly delayed. The output signal of the inverter 72 is supplied to the gate of the PMOS 32 and the output signal of the inverter 74 is supplied to the gate of the NMOS 34. Consequently, the PMOS 32 and the NMOS 34 are turned on slightly after the rising edge of the clock signal CK to generate the driving voltage V2 as an output signal OUT.

According to the second embodiment, as mentioned above, the driving circuit uses the inverter 71 and the like for PMOS control and the inverter 74 and the like for NMOS control, which have different characteristics at the rising and falling edges, to control the turning on/off of the driving voltages V1 to V4. Consequently, it is possible to form a slight difference in time upon selecting among the driving voltages V1 to V4, so that a leakage current can be prevented. Further, there is an advantage in that the leakage current in the inverter 71, 74, or the like itself can be suppressed.

Third Embodiment

Figure 7:
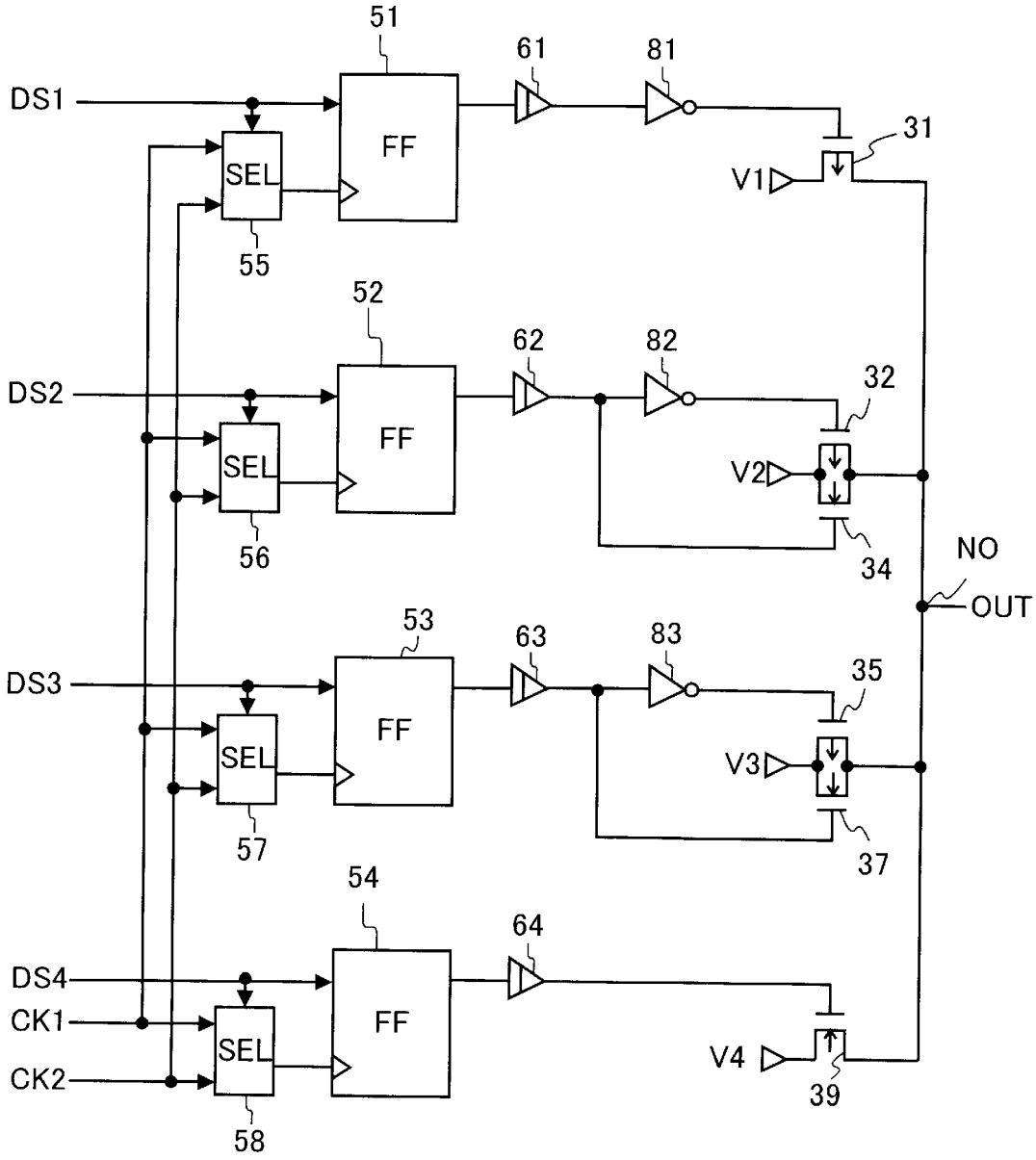
FIG. 7 is a block diagram showing a driving circuit for LCD according to a third preferred embodiment of the present invention.

FIG. 7 is a circuit diagram of a driving circuit showing a third embodiment of the present invention. Components common to those in FIG. 5 are designated by the same reference numerals and symbols.

The driving circuit uses the two-phase clock signals CK1 and CK2, similar to FIG. 2, instead of the clock signal CK in FIG. 5 and has selecting circuits (for example, selectors) 55 to 58 for switching one of the clock signals CK1 and CK2 to the other one and supplying it to the holding circuits (for example, FFs) 51 to 54. The selectors 55 to 58 are similar to the selectors 14 and 15 in FIG. 2. Each selector selects one of the clock signals CK1 and CK2 in accordance with the level "L" or "H" of the signal supplied to the control terminal and generates the selected clock signal.

In the driving circuit, normal inverters 81, 82, and 83 are used instead of the inverters 71, 72, and 75 for PMOS control in FIG. 5, the inverters 73, 74, 76, 78, and 79 in FIG. 5 are eliminated, the outputs of the level shifter 62, 63, and 64 are directly connected to the gates of the NMOSs 34, 37, and 39, respectively. The other construction is the same as that in FIG. 5.

Subsequently, the operation will now be explained.

For example, it is assumed that at a certain point in time, the selection signal DS1 for selecting a driving voltage for display changes from the level "H" to the level "L" and the selection signal DS2 changes from the level "L" to the level "H". Consequently, the selector 55 selects the clock signal CK1, the selector 56 selects the clock signal CK2, the clock signal CK1 is supplied to the FF 51, and the clock signal CK2 is supplied to the FF 52. Since there is no change in the clock signals CK1 and CK2 at this point in time, the output signals of the FFs 51 and 52 denote the levels "H" and "L", respectively, and do not change. Therefore, the driving voltage VI is outputted as an output signal OUT.

Subsequently, when the clock signal CK1 rises, the FF 51 holds the selection signal DS1, so that the output signal of the FF 51 goes to the level "L". Consequently, the PMOS 31 is turned off, the driving voltage V1 as an output signal OUT is cut off, and the output node NO enters a floating state.

Further, when the clock signal CK2 rises slightly after the rising edge of the clock signal CK1, the FF 52 holds the selection signal DS2, so that the output signal of the FF 52 becomes the level "H". Consequently, the PMOS 32 and NMOS 34 are turned on and the driving voltage V2 is generated as an output signal OUT from the output node NO.

According to the third embodiment, as mentioned above, the driving circuit uses the two clock signals CK1 and CK2 having different phases and thus a period during which none of the driving voltages VI to V4 generate occurs. Consequently, there is an advantage in that the leakage current among the driving voltages V1 to V4 can be prevented.

Fourth Embodiment

Figure 8:
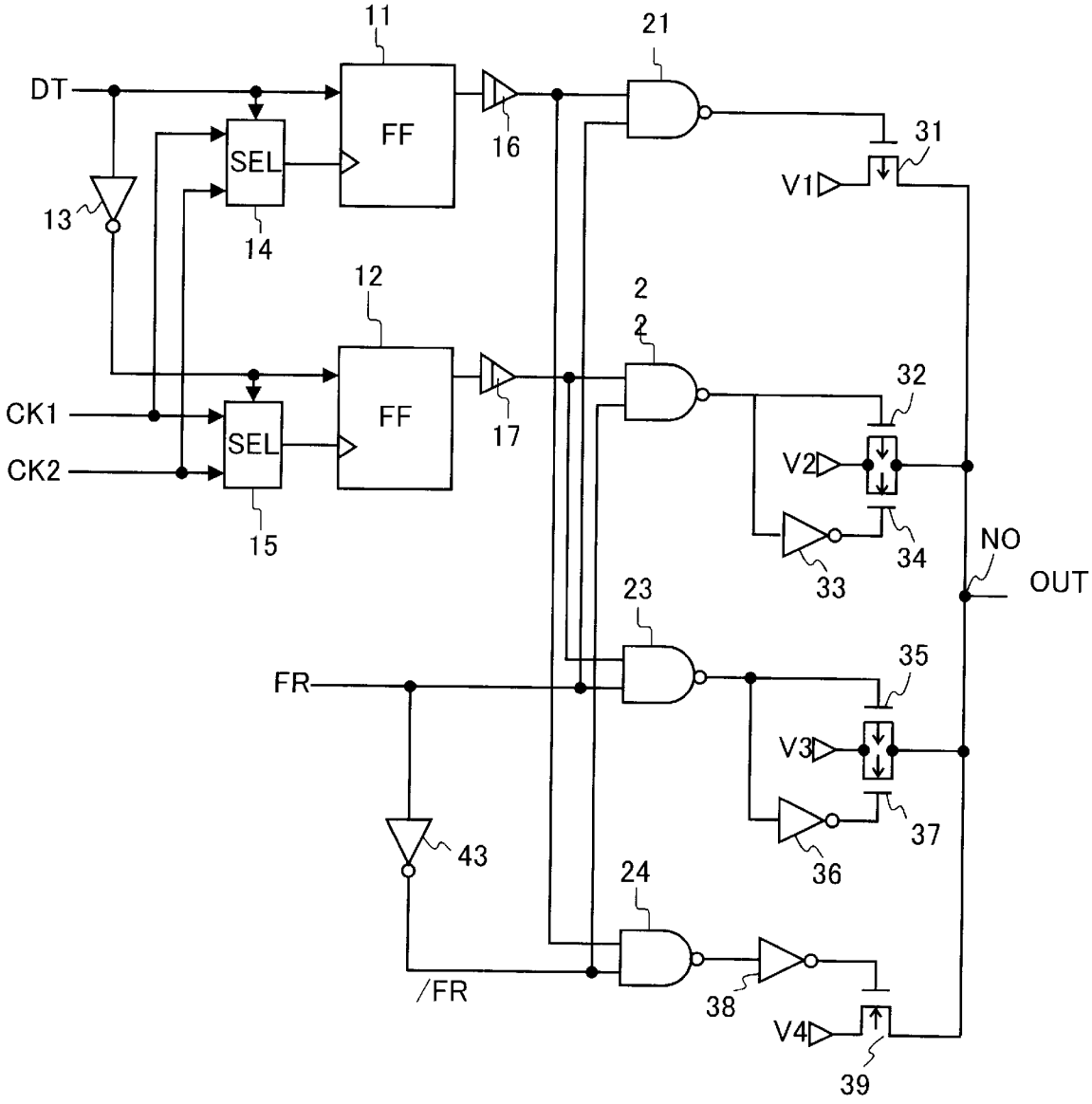
FIG. 8 is a block diagram showing a driving circuit for LCD according to a fourth preferred embodiment of the present invention.

FIG. 8 is a circuit diagram of a driving circuit showing a fourth embodiment of the present invention. The same reference numerals and symbols designate components common to those in FIG. 2.

The driving circuit is constructed so that the FFs 41 and 42 and the like in the frame control unit 40 in FIG. 2 are eliminated, the frame control signal FR is directly supplied to the NAND 23, and the frame control signal FR is inverted by the inverter 43 and then supplied to the NAND 24. The other construction is similar to that in FIG. 2.

The operation of the driving circuit is substantially the same as that in FIG. 2.

Namely, the operation when the display data DT changes is exactly the same as that in FIG. 2.

On the other hand, when the frame control signal FR changes, asynchronously with the clock signals CK1 and CK2, one of the driving signals S21 to S24 outputted from the NANDs 21 to 24 of the decoding unit is switched to another one to switch one of the driving voltages V1 to V4 to another voltage outputted as an output signal OUT to the output node NO.

According to the fourth embodiment, as mentioned above, the driving circuit uses the two clock signals CK1 and CK2 having different phases to set a period during which none of the driving voltages VI to V4 generate upon changing the display data DT. On the other hand, the change in frame control signal FR occurs, e.g., 30 times per second. Since it is less than or equal to 1/100 of the rate of the change in display data DT, the frame control unit dealing with the frame control signal FR is eliminated to simplify the circuitry.

Further, the NANDs 21 to 24 of the decoding unit are constructed so as to extend the delay time at the falling edge of the output signal and the inverters 33, 36, and 38 are constructed so as to extend the delay time at the rising edge of the output signal. Consequently, there is such an advantage that after one of the NMOS and PMOS of the switching unit is turned off, a period elapsed before the turn-on is extended, so that the leakage current can be effectively prevented.

The present invention is not limited to the above embodiments but many modifications and variations are possible. For example, the following modifications (a) to (f) are possible.

(a) Although the decoding unit 20 in FIG. 2 uses the NANDs 21 to 24 each comprising the PMOSs and NMOSs having different mutual conductance gm from each other as shown in FIG. 3A so as to function as the decoding circuit and driving control circuit, it can be also constructed by using normal NANDs as decoding circuits. As the inverters 33, 36, and 38 of the switching unit 30, normal inverters can be also used.

(b) The driving circuit in FIG. 5 can be also constructed in such a manner that the selectors 55 to 58, similar to those in FIG. 7, are provided so as to select one of the clock signals CK1 and CK2 and supply it to the FFs 51 to 54. Consequently, the leakage current can be more effectively prevented.

(c) According to the first to fourth embodiments, the circuits for selecting one signal from among the four kinds of driving voltages V1 to V4 and generating it have been described. The driving voltages of any number of kinds are similarly applicable so long as the number of kinds is two or more.

(d) The constitution of the decoding unit 20 and that of the switching unit 30 are not limited to those in the diagrams.

(e) The level shifter 16 and the like can be arranged at appropriate positions in the circuitry as required.

(f) The driving circuit for displaying the LCD has been explained as an example. For example, in a booster circuit for alternately switching between two kinds of voltages and charging it in a capacitor to generate a high voltage, it can be applied as a driving circuit for switching.

What is claimed is:

1. A driving circuit having a plurality of switching circuit for, when receiving respective corresponding driving signals, outputting driving voltages corresponding to said driving signals to a common output node, said driving circuit comprising:

a selecting circuit for selecting a first clock signal when a selection signal to select said driving voltage is inactivated and, when said selection signal is activated, selecting a second clock signal delayed in phase relative to said first clock signal; and a holding circuit for holding said selection signal on the basis of timing of the clock signal selected by said selecting circuit, and supplying the held contents as a driving signal to said switching circuit.

2. A driving circuit having a plurality of switching circuit for, when receiving respective corresponding driving signals, outputting driving voltages corresponding to said driving signals to a common output node, said driving circuit comprising:

a selecting circuit for selecting a first clock signal when a selection signal to select said driving voltage is inactivated and, when said selection signal is activated, selecting a second clock signal delayed in phase relative to said first clock signal;

a holding circuit for holding the selection signal on the basis of timing of the clock signal selected by said selecting circuit; and a control circuit for outputting the driving signal so as to be delayed by a predetermined time period when the selection signal held by said holding circuit is activated, and when the selection signal is inactivated, immediately interrupting the driving signal.

3. A driving circuit having a plurality of switching circuit for, when receiving respective corresponding driving signals, outputting driving voltages corresponding to said driving signals to a common output node, said driving circuit comprising:

a selecting circuit for selecting a first clock signal when an input signal is inactivated and, when said input signal is activated, selecting a second clock signal delayed in phase relative to said first clock signal;

a holding circuit for holding the input signal on the basis of timing of the clock signal selected by said selecting circuit; and a decoding circuit for decoding the held contents of said holding circuit to form the driving signal for selecting said driving voltage and supply said driving signal to said switching circuit.

4. A driving circuit having a plurality of switching circuit for, when receiving respective corresponding driving signals, outputting driving voltages corresponding to said driving signals to a common output node, said driving circuit comprising:

a selecting circuit for selecting a first clock signal when an input signal is inactivated and, when said input signal is activated, selecting a second clock signal delayed in phase relative to said first clock signal;

a holding circuit for holding said input signal on the basis of timing of the clock signal selected by said selecting circuit;

a decoding circuit for decoding the held contents of said holding circuit to form a selection signal for selecting said driving voltage; and a control circuit for outputting the driving signal so as to be delayed by a predetermined time period when said selection signal is inactivated, and when the selection signal is inactivated, immediately interrupting the driving signal.

5. A driving circuit having a plurality of switching circuits for, when receiving respective corresponding driving signals, outputting driving voltages corresponding to said driving signals to a common output node, said driving circuit comprising a driving control circuit for, when a selection signal to select said driving voltage is activated, outputting the driving signal so as to be delayed by a predetermined time period and, when the selection signal is inactivated, immediately interrupting the driving signal, wherein said driving control circuit is constructed by logic gates each having an output unit obtained by serially connecting complementary MOS transistors having different mutual conductance from each other.

6. A driving circuit for outputting any one of a plurality of driving voltages to a common output node, said driving circuit comprising:

a driving signal output circuit for outputting a plurality of driving signals corresponding to said plurality of driving voltages on the basis of a plurality of selection signals; and a plurality of switching circuit, which are controlled by said plurality of driving signals, respectively, for outputting the driving signal corresponding to any one of the plurality of driving voltages to said output node, wherein said driving signal output circuit generates the plurality of driving signals to allow a transition from an ON state to an OFF state of said switching circuit to be faster than that from the OFF state to the ON state of the switching circuit.

7. The driving circuit according to claim 6, wherein the driving signal output circuit has a first conductivity type first MOS transistor coupled between an output terminal thereof and a power supply potential and a second conductivity type second MOS transistor coupled between said output terminal and a ground potential, when the switching circuit is a first conductivity type MOS transistor, the ratio of gate length to gate width of said second MOS transistor is larger than that of said first MOS transistor, and when the switching circuit is a second conductivity type MOS transistor, the ratio of gate length to gate width of the first MOS transistor is larger than that of the second MOS transistor.

8. The driving circuit according to claim 6, wherein the driving signal output circuit has a first conductivity type first MOS transistor coupled between an output terminal thereof and a power supply potential and a second conductivity type second MOS transistor coupled between said output terminal and a ground potential, when the switching circuit is a first conductivity type MOS transistor, the ratio of gate width to gate length of said second MOS transistor is smaller than that of said first MOS transistor, and when the switching circuit is a second conductivity type MOS transistor, the ratio of gate width to gate length of the first MOS transistor is smaller than that of the second MOS transistor.

9. The driving circuit according to claim 6, wherein said driving signal output circuit has a first conductivity type first MOS transistor coupled between an output terminal thereof and a power supply potential and a second conductivity type second MOS transistor coupled between said output terminal and a ground potential, when the switching circuit is a first conductivity type MOS transistor, the ON resistance of said second MOS transistor is larger than that of said first MOS transistor, and when the switching circuit is a second conductivity type MOS transistor, the ON resistance of the first MOS transistor is larger than that of the second MOS transistor.

10. The driving circuit according to claim 6, wherein the driving signal is outputted so as to control the switching circuit on the basis of one of a first clock signal and a second clock signal delayed in phase relative to said first clock signal, when the driving signal allows the switching circuit to change from the OFF state to the ON state, the driving signal is outputted on the basis of said second clock signal, and when the driving signal allows the switching circuit to change from the ON state to the OFF state, the driving signal is outputted on the basis of the first clock signal.

11. The driving circuit according to claim 10, further comprising:

a clock signal selecting circuit for selecting either one of the first and second clock signals;

a selection signal holding circuit for holding the selection signal on the basis of one of the first and second clock signals selected by said clock signal selecting circuit; and a decoding circuit for decoding the held contents of said selection signal holding circuit to form the driving signal corresponding to the driving voltage.

12. A driving circuit for outputting one of first and second driving voltages to a common output node, said driving circuit comprising:

a first driving signal output circuit for outputting a first driving signal corresponding to said first driving voltage on the basis of a first selection signal;

a second driving signal output circuit for outputting a second driving signal corresponding to said second driving voltage on the basis of a second selection signal;

a first switching circuit, which is controlled by said first driving signal, for outputting said first driving voltage to said output node; and a second switching circuit, which is controlled by said second driving signal, for outputting said second driving voltage to the output node, wherein the first and second driving signal output circuits output the first and second driving signals for allowing a transition from an ON state to an OFF state of said second switching circuit to be faster than that from the OFF state to the ON state of said first switching circuit, respectively.

13. The driving circuit according to claim 12, wherein one of the first and second driving signal output circuits has a first conductivity type first MOS transistor coupled between an output terminal thereof and a power supply potential and a second conductivity type second MOS transistor coupled between said output terminal and a ground potential, when one of the first and second switching circuits is a first conductivity type MOS transistor, the ratio of gate length to gate width of the second MOS transistor is larger than that of the first MOS transistor, and when one of the first and second switching circuits is a second conductivity type MOS transistor, the ratio of gate length to gate width of the first MOS transistor is larger than that of the second MOS transistor.

14. The driving circuit according to claim 12, wherein one of the first and second driving signal output circuits has a first conductivity type first MOS transistor coupled between an output terminal thereof and a power supply potential and a second conductivity type second MOS transistor coupled between said output terminal and a ground potential, when one of the first and second switching circuits is a first conductivity type MOS transistor, the ratio of gate width to gate length of the second MOS transistor is smaller than that of the first MOS transistor, and when one of the first and second switching circuits is a second conductivity type MOS transistor, the ratio of gate width to gate length of the first MOS transistor is smaller than that of the second MOS transistor.

15. The driving circuit according to claim 12, wherein one of the first and second driving signal output circuits has a first conductivity type first MOS transistor coupled between an output terminal thereof and a power supply potential and a second conductivity type second MOS transistor coupled between said output terminal and a ground potential, when one of the first and second switching circuits is a first conductivity type MOS transistor, the ON resistance of the second MOS transistor is larger than that of the first MOS transistor, and when one of the first and second switching circuits is a second conductivity type MOS transistor, the ON resistance of the first MOS transistor is larger than that of the second MOS transistor.

16. The driving circuit according to claim 12, wherein the first and second driving signals are outputted so as to control the first and second switching circuits on the basis of one of a first clock signal and a second clock signal delayed in phase relative to said first clock signal, when the first switching circuit changes from an OFF state to an ON state by the first driving signal, the first driving signal is outputted on the basis of said second clock signal, and when the second switching circuit changes from the ON state to the OFF state by the second driving signal, the second driving signal is outputted on the basis of the first clock signal.

17. The driving circuit according to claim 16, further comprising:

a clock signal selecting circuit for selecting either one of the first and second clock signals;

first and second selection signal holding circuits for holding the first and second selection signals on the basis of the first or second clock signals selected by said clock signal selecting circuit, respectively; and first and second decoding circuits for decoding the held contents of said first and second selection signal holding circuits to form the first and second driving signals corresponding to the first and second driving voltages, respectively.

* * * * *